US009846016B2

(12) United States Patent
Drouin, Jr. et al.

(10) Patent No.: US 9,846,016 B2
(45) Date of Patent: Dec. 19, 2017

(54) PROJECTILE DELIVERY OF DISRUPTIVE MEDIA FOR TARGET PROTECTION FROM DIRECTED ENERGY

(71) Applicant: The Boeing Company, Chicago, IL (US)

(72) Inventors: Donald V. Drouin, Jr., O'Fallon, IL (US); Mark J. Clemen, Jr., Port Orchard, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/088,286

(22) Filed: Apr. 1, 2016

(65) Prior Publication Data

US 2017/0284780 A1 Oct. 5, 2017

(51) Int. Cl.

| | |
|---|---|
| ***F42B 12/48*** | (2006.01) |
| ***F42B 12/50*** | (2006.01) |
| ***F42B 15/01*** | (2006.01) |
| ***F41H 13/00*** | (2006.01) |

(52) U.S. Cl.

CPC ..... *F42B 12/50* (2013.01); *F41H 13/0062* (2013.01); *F42B 12/48* (2013.01); *F42B 15/01* (2013.01)

(58) Field of Classification Search

CPC ..... F42B 12/42; F42B 12/46; F42B 12/48; F42B 12/50; F41H 11/02; F41H 13/00

USPC ..... 89/1.1

See application file for complete search history.

(56) References Cited

U.S. PATENT DOCUMENTS 4,168,663 A * 9/1979 Kohler ..... F42C 13/04 102/214
4,232,609 A * 11/1980 Held ..... F41G 7/2246 102/214
4,421,007 A * 12/1983 Hanes, Jr. ..... B64D 7/00 89/1.11

OTHER PUBLICATIONS

Drouin Jr., Donald V. et al., "Systems and Methods for Protecting a Vehicle from a Directed Energy Attack", U.S. Appl. No. 14/923,677, filed Oct. 27, 2015, 22 pgs.

* cited by examiner

*Primary Examiner* — Stephen Johnson
(74) *Attorney, Agent, or Firm* — Kwan & Olynick LLP

(57) ABSTRACT

Methods, devices, and systems may protect a target from undesirable electromagnetic radiation by detecting electromagnetic radiation (including coherent radiation such as laser beams) aimed at a target from a source; calculating a first release position to disrupt the electromagnetic radiation thereby protecting the target; launching a projectile that may include a disruptive medium or a disruptive-medium precursor; directing the projectile to the first release position; and releasing the disruptive medium from the projectile at the first release position, such that the releasing of the disruptive medium forms a cloud of the disruptive medium.

20 Claims, 9 Drawing Sheets

PROJECTILE DELIVERY OF DISRUPTIVE MEDIA FOR TARGET PROTECTION FROM DIRECTED ENERGY

BACKGROUND

The field of the present disclosure relates generally to automated defense systems and, more specifically, to systems and methods for protecting aircraft and other objects from laser beams and generalized electromagnetic radiation emitted by directed-energy weapons and tracking systems.

At least some known directed energy sources, such as high-energy laser weapons and high-power microwave weapons, are becoming an increasingly prominent threat to aircraft and other targets. More specifically, directed energy weapons are capable of channeling a large amount of stored energy towards a target at the speed of light. As such, avoidance techniques for directed energy weapons are typically different from avoidance techniques implemented for traditional projectile-type weapons. For example, the aircraft may be externally covered by paints or coatings, or may be manufactured from heavy and robust materials such that the aircraft is capable of withstanding a directed energy attack for an increased amount of time. However, modifying the construction of the aircraft may increase its overall weight, thereby reducing the fuel efficiency and performance of the aircraft.

The pilot (or, in the case of unmanned drones, the remote controller or piloting software) of an aircraft under directed energy attack can sometimes maneuver the aircraft to reduce the intensity of the directed energy received at the aircraft. However, in such a scenario, an amount of damage to the aircraft is directly dependent on the reaction time of and types of maneuvers selected by the pilot, controller, or software of the aircraft.

As used herein, "electromagnetic radiation" shall mean any subset of the full spectrum of electromagnetic waves transmissible through vacuum. Despite any narrower uses of the term in any specialized industry, this encompasses radio waves, microwaves, infrared light, visible light, ultraviolet light, X-rays, gamma rays, and any other self-propagating transverse oscillating wave of electric and magnetic fields. The waves may be pulsed or continuous, polarized or unpolarized, incoherent or coherent. Laser and maser emissions, being types of light and microwave radiation respectively, shall be included in the umbrella term "electromagnetic radiation" herein unless otherwise explicitly stated.

SUMMARY

Provided are methods that may include detecting electromagnetic (including laser) radiation aimed at a target from a source; calculating source location and source radiation vector; calculating a first release position to disrupt the electromagnetic radiation thereby protecting the target and enabling the target to escape following a path that maximizes protection from the electromagnetic radiation; launching a projectile that may include a disruptive medium or a disruptive-medium precursor; directing the projectile to the first release position; and releasing the disruptive medium from the projectile at the first release position, such that the releasing of the disruptive medium forms a cloud of the disruptive medium that will help shield the target from the electromagnetic radiation and enable the target to escape the threat area safely along an optimal path and with minimal damage to airframe, systems, and personnel.

In some embodiments, at least one of the detecting, the calculating, or the launching is performed at the target. Alternatively, in some embodiments, at least one of the detecting, the calculating, or the launching is performed remotely from the target. The calculating of the first release position may include computing a position of the source and computing a distance from the source at which the cloud obscures a predetermined range of a propagation angles (a) of the electromagnetic radiation. Where applicable, the source's movement vector (if not stationary in the frame of reference for the calculations) and/or the movement vector of the cloud of disruptive medium (which may, for example, move due to winds and gravity) may also need to be considered to optimize calculations and protection of target.

In some embodiments, the methods may also include calculating a second release position to disrupt the electromagnetic radiation thereby continuing to protect the target; directing the projectile to the second release position; and releasing the disruptive medium from the projectile at the second release position; such that the releasing of the disruptive medium forms a cloud of the disruptive medium.

The electromagnetic radiation may include tracking radiation, in which case calculating the first release position may involve computing a time at which the source locks reliably onto a position of the target or a trajectory of the target. Alternatively, the electromagnetic radiation may include damaging radiation, in which case calculating the first release position may involve computing a time at which the electromagnetic radiation causes an unacceptable amount of damage to the target.

In some embodiments, the projectile may be selected from a set of projectiles based on a sensed parameter of the electromagnetic radiation; the disruptive medium may differ in composition, constituent size, quantity, or a number of charges between an at least two members of the set of projectiles. In some embodiments, the launching of the projectile may include the use of at least one of gravity, compressed gas, expanding gas, an electromagnetic field, or an engine attached to the projectile.

Optional post-launch features of the method may include changing the course of the projectile after launching; sensing a change in the electromagnetic radiation or a relative position of the source and the target after launching and re-calculating the first release position to compensate for the change; having the projectile guided toward the first release position by a remote system or by a system internal to the projectile. Optionally, the releasing of the cloud may be triggered by a system internal to the projectile and may include one or more of spraying, misting, burning, or explosion.

Provided are projectiles that may include: a first container of a first disruptive medium or a disruptive-medium precursor; a first release mechanism operable to release the first disruptive medium from the first container; a controller linked to the first release mechanism; calculation logic linked to the controller; wherein the controller triggers the first release mechanism to release the first disruptive medium at a first release position; wherein the calculation logic calculates the first release position in response to detection of electromagnetic radiation by a sensor linked to the controller or with the calculation logic.

Additionally, the projectile may include a second container of a second disruptive medium or disruptive-medium precursor having a second release mechanism linked to the controller. The controller may trigger the second release mechanism to release the second disruptive medium at a second release position, and the second release position may differ from the first release position. At least one of the controller, the sensor, or the calculation logic may be internal to the projectile.

Provided are systems that may include: a sensor capable of detecting electromagnetic radiation aimed at a target; a measurement module capable of characterizing the electromagnetic radiation; calculation logic capable of calculating a first release position for a disruptive-medium cloud to protect the target based on a characterization by the measurement module; at least two of a clock, a position sensor, or a velocimeter; a projectile launcher; a projectile capable of releasing the disruptive-medium cloud; and control logic capable of triggering a release of the disruptive-medium cloud at the first release position. In some embodiments, the systems may include adaptive logic capable of changing the course of the projectile and/or recalculating the first release position in response to a change in the characterization while the projectile is in motion.

DETAILED DESCRIPTION

Figure 1A:
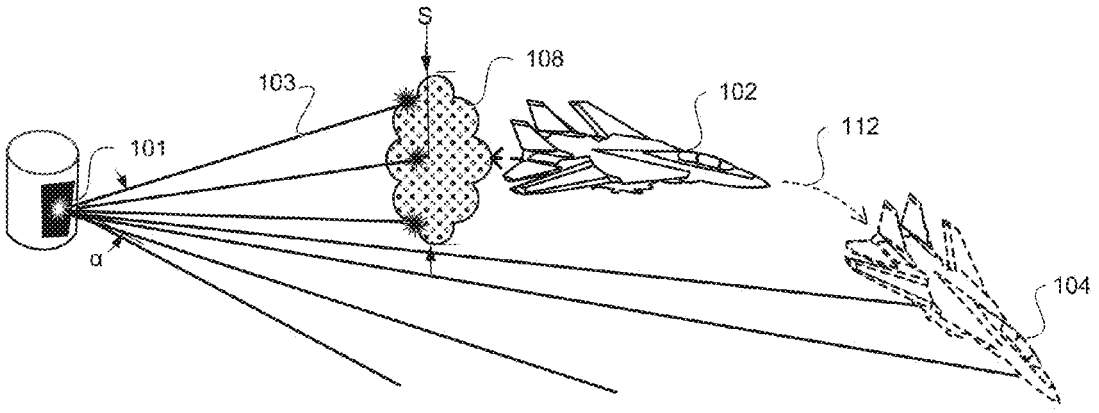
FIG. 1A is an example of a target system releasing a cloud of disruptive medium and continuing its trajectory.

In the following description, numerous specific details are set forth in order to provide a thorough understanding of the presented concepts. The presented concepts may be practiced without some or all of these specific details. In other instances, well known process operations have not been described in detail so as to not unnecessarily obscure the described concepts. While some concepts will be described in conjunction with the specific embodiments, it will be understood that these embodiments are not intended to be limiting.

For example, the illustrations may describe aerial applications, but those skilled in the art will apprehend that the same defensive-projectile methods, apparatus, and devices may be straightforwardly adaptable to space, air, land, and water environments.

Introduction

Some applications involve detecting electromagnetic radiation and responding by launching a projectile that carries a charge of disruptive medium or a precursor for a disruptive medium. The launched projectile travels to a release position, transforms the precursor into disruptive medium if applicable, and releases a cloud of disruptive medium between the source of the electromagnetic radiation and the target, effectively blocking the electromagnetic radiation from locking onto, damaging, or causing other harm to the target. The disruptive medium may reflect, redirect, diffuse/refract, or absorb the electromagnetic or laser radiation, thus reducing or eliminating the amount of energy reaching the target structure, systems or personnel.

The projectiles may include bullets, artillery shells, boosted ordnance, missiles, or any other suitable type of projectile known at the time of deployment. The launching mechanism may include a small gun, large gun, rail-gun, gravity weapon, or any other suitable type of launcher known at the time of deployment, optionally responding dynamically to detected changes in the electromagnetic radiation. The disruptive medium may form a single cloud, a series of clouds, or a stream, blocking the electromagnetic radiation by absorption, re-radiation with less-dangerous parameters, scattering, or reflection.

The release position may be determined by calculations using the detected parameters of the electromagnetic radiation such as intensity, wavelength, direction, spatial intensity profile, or temporal intensity profile (e.g., pulsed or continuous-wave). A source movement vector (if source is not stationary in the calculation frame of reference), and/or a cloud movement vector due to frame of reference, gravity, expansion, and winds, and the target escape navigation path also impact the optimized release position. Similarly, the target escape navigation path may also be optimized, and the optimization may depend on the optimized projectile trajectory and the disruptive medium cloud release position. The release position may be time-driven to release the disruptive medium between the target and the source of the electromagnetic radiation before the target is exposed to an unacceptable amount of electromagnetic radiation. Alternatively, the release position may be extent-driven to form the cloud of disruptive medium in a position that blocks most or all of the source's emitted radiation at propagation angles that intersect with the target's trajectory. The projectile's trajectory and release position may be programmed in before launching; alternatively, control logic in the projectile, the target, or elsewhere may continue to guide the projectile,

Examples

FIG. 1A is an example of a target system releasing a cloud of disruptive medium and continuing its trajectory.

Source 101 emits electromagnetic radiation 103 over a range of propagation angles $\alpha$. Electromagnetic radiation 103 may be tracking radiation intended to record the movements of targets, damaging radiation (or an aiming beam for damaging radiation) intended to damage targets, or electromagnetic radiation intended for some other purpose. When target 102 detects electromagnetic radiation 103, target 102 releases cloud 108 of a disruptive medium. The disruptive medium may scatter, reflect, fully absorb, or absorb and partially re-radiate (e.g., act as a blackbody for) electromagnetic radiation 103.

At any given time after release, cloud 108 has a finite cloud size. If target 102 follows target trajectory 112, and cloud 108 has reached the illustrated cloud size S when target 102 reaches target position 104, it may fail to block electromagnetic radiation 103 from reaching target 102 at that point. Moreover, if target 102 at target position 104 is irradiated on a surface that is not equipped to release another cloud 108, it cannot effectively block the additional electromagnetic radiation 103 that is not already blocked by cloud 108. If target 102 also lacks sensors on that surface, it may not detect the additional electromagnetic radiation 103.

Figure 1B:
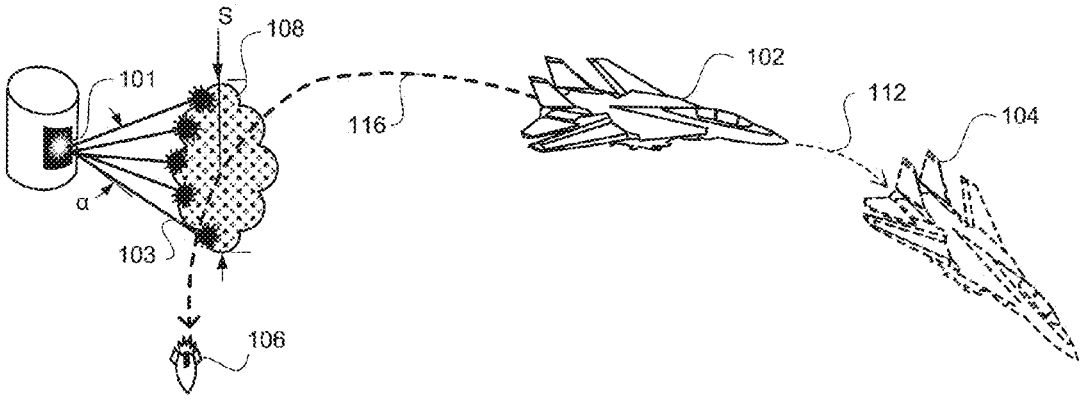
FIG. 1B is a diagram of a target launching a projectile that releases a cloud of disruptive medium, in accordance with some embodiments.

FIG. 1B is a diagram of a target launching a projectile that releases a cloud of disruptive medium, in accordance with some embodiments.

In some embodiments, target 102 responds to detection of electromagnetic radiation 103 by launching projectile 106. Projectile 106 carries one or more charges of a disruptive medium or a precursor that can be transformed into a disruptive medium. In some embodiments, projectile 106 has projectile trajectory 116, either programmed before launching or guided after launching. Projectile trajectory 116 may include one or more trajectory changes before or after releasing cloud 108 of disruptive medium. In some embodiments, projectile trajectory 116 takes the projectile near the source such that cloud 108 of cloud size S blocks the full range of propagation angles $\alpha$ of the electromagnetic radiation 103. Thereafter, regardless of target trajectory 112, electromagnetic radiation 103 is blocked and target 102 is protected. Alternatively, the release position of projectile 106 can be selected to block only part of the range of propagation angles $\alpha$, such as an angular spread that covers target trajectory 112 or an angular spread that transmits too little of electromagnetic radiation 103 to have its intended effect (tracking, damage, reduced survivability characteristics by causing a survivable target to fluoresce, reflect, re-radiate etc.). That is, the unblocked fraction of electromagnetic radiation 103 is below some critical threshold in power, energy, power density, or energy density.

Figure 2:
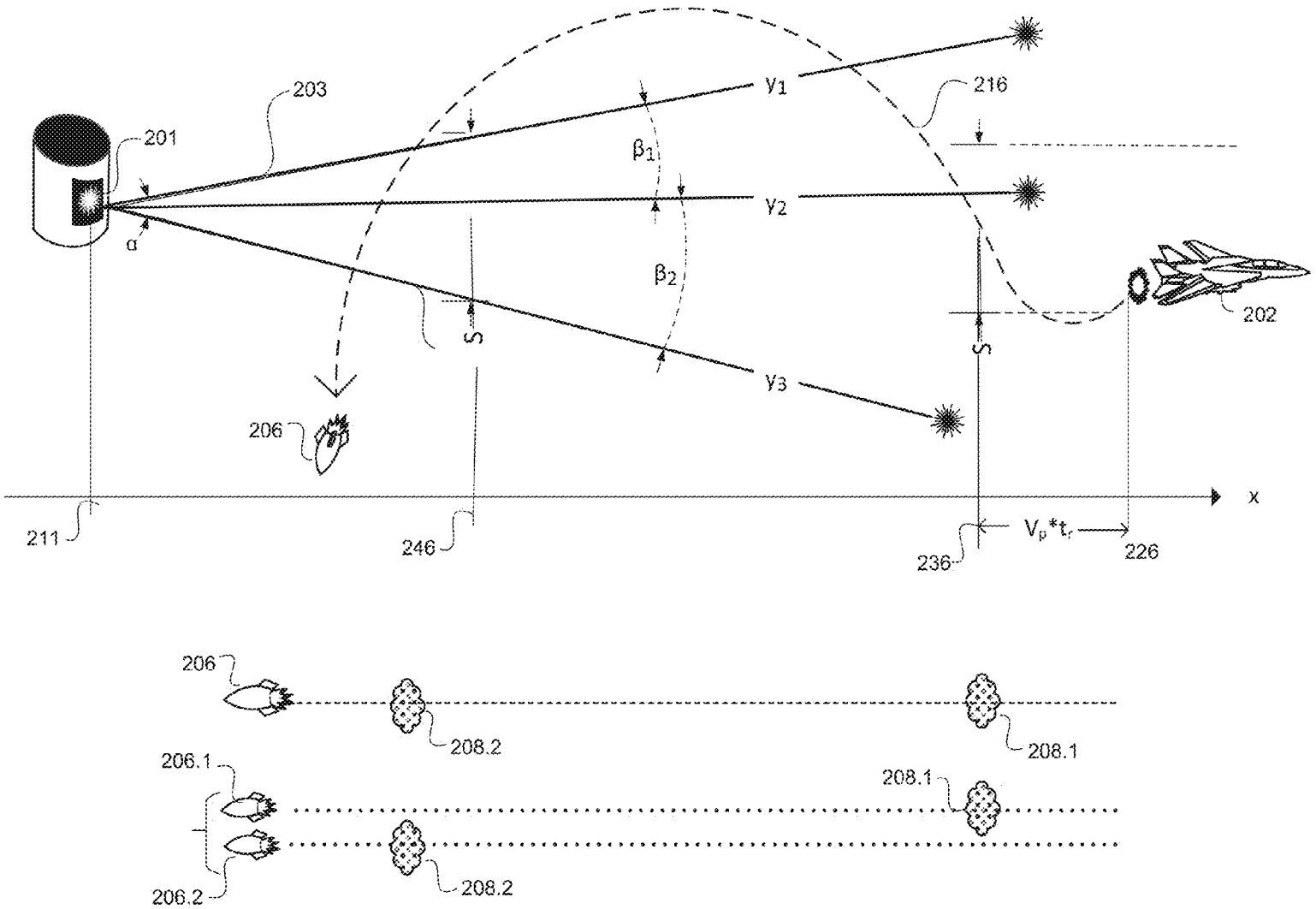
FIG. 2 is a diagram illustrating different options for disruptive-medium release positions, in accordance with some embodiments.

FIG. 2 is a diagram illustrating different options for disruptive-medium release positions, in accordance with some embodiments.

In some embodiments, another consideration is to release the disruptive medium and protect the target within a "maximum safe time" (MST) window before the electromagnetic radiation can effectively perform its intended function. For example, source 201 may need time to lock onto a trajectory of target 202 for reliable tracking or aiming. To prevent this, some embodiments of the system measure characteristics of electromagnetic radiation 203, such as wavelength, intensity, or incident angle on target 202, and calculate the MST. Projectile 206 may then be launched and controlled to release the disruptive medium at or before the MST. The resulting release position (time-driven release position 236) is determined by launch position 226, the velocity and trajectory of projectile 206, and the release time (≤MST).

If source 201 has a fast processor, the MST may be very short, forcing first release position 236 to be fairly close to launch position 226. The disruptive medium cloud of cloud size S may thus block only a minor fraction of the propagation angles of electromagnetic radiation 203. One possibility is to release multiple charges of disruptive medium. For example, after releasing a first cloud 208.1 at first release position 236, projectile 206 could follow projectile trajectory 216 toward source 201 and release a second cloud 208.2 at a second release position (an "extent-driven release position" 246). At extent-driven release position 246 a cloud size S may block more, or even all, of the propagation angles of electromagnetic radiation 203. A release at this position may thus protect target 202 as long as second cloud 208.2 persists, regardless of the subsequent target trajectory.

Like time-driven release position 236, extent-driven release position 246 may be predicted from measurements of electromagnetic radiation 203 or other accessible parameters of source 201. Extent-driven release position 246 may be calculated by measuring at least two propagation angles $\beta_1$, $\beta_2$ of electromagnetic radiation 203, extrapolating their geometric convergence point (or, if electromagnetic radiation 203 is coherent, the Gaussian or multimode waist) to derive a source distance from the measurement position, which yields source position 211. Measuring the intensity of electromagnetic radiation 203 at three or more transverse points such as $y_1$, $y_2$, $y_3$ may be used to calculate an intensity profile, from which the range of propagation angles $\alpha$ may be estimated. Alternatively, other known methods (such as visually inspecting source 201 and identifying it in a lookup table as a known type, calculating its position 211 from its known size and its imaged size, and looking up the divergence associated with that known type) may be used to compute extent-driven release position 246.

Alternatively, multiple projectiles such as 206.1 and 206.2, each carrying a single charge of disruptive medium, may be launched. For example, this approach may be expedient if releasing the disruptive medium involves the complete or near-complete destruction of the projectile, such as by explosion. First projectile 206.1 may release first cloud 208.1 at time-driven release position 236 and second projectile 206.2 may release second cloud 208.2 at extent-driven release position 246.

If time-driven release position 236 and extent-driven release position 246 are approximately coincident, or if time-driven release position 236 is closer than extent-driven release position 246 to source position 211, the solution may be simplified; a single disruptive-medium release may be sufficient to protect the target as it follows its subsequent trajectory.

Figure 3:
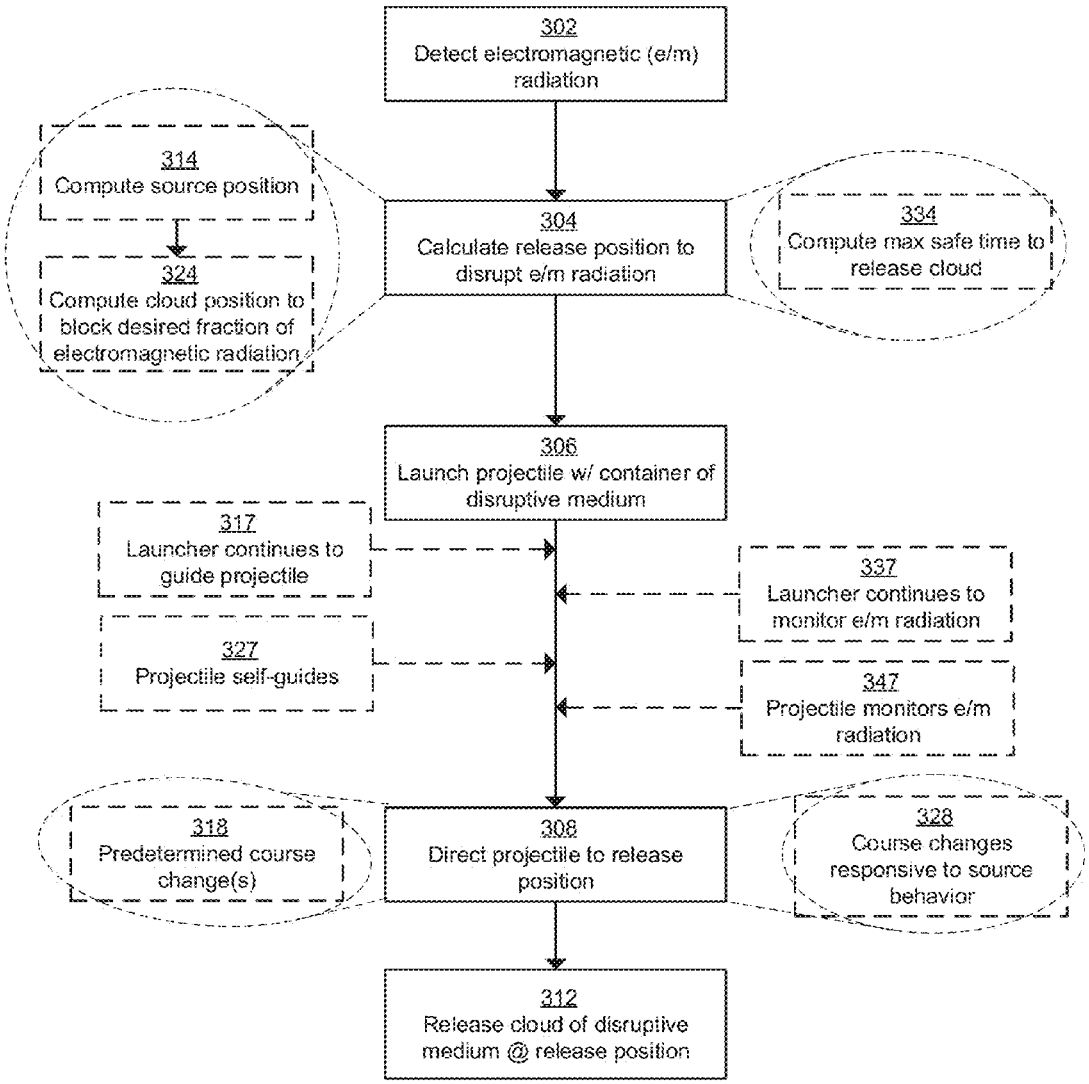
FIG. 3 is a flowchart of a method for using a projectile having at least one charge of disruptive media, in accordance with some embodiments.

FIG. 3 is a flowchart of a method for using a projectile having at least one charge of disruptive media, in accordance with some embodiments.

In some embodiments, the method may begin with Operation 302, which may include detecting an electromagnetic radiation aimed at a target from a source. The detecting apparatus may be on the target or on a remote platform with access to information about the environment around the target. In some embodiments, the detecting apparatus may be built into the projectile(s).

Operation 304 may include calculating a first release position to disrupt the electromagnetic radiation, thereby protecting the target. This is where the projectile will create a cloud of disruptive media between the source and the target. Among the possible calculations of the first release position may be Operation 314, computing a position of the source. The computed position may either be absolute (referenced to some external coordinate system), relative to the target, and/or relative to a remote platform where applicable.

Another possible calculation component may be Operation 324, computing a distance from the source at which the cloud obscures a predetermined range of propagation angles of the electromagnetic radiation. This may be, for example, the distance at which the cloud blocks all the electromagnetic radiation coming from the source, or all the electromagnetic radiation above a critical threshold such as a detection threshold or a damage threshold, or all the electromagnetic radiation that does or soon will intersect with a path of the target relative to the source (note that because of the frame of reference, the target has a "path relative to the source" whether the source is stationary and the target moves, or the target is stationary and the source moves, or both the source and the target move).

An additional possible calculation component may be Operation 334, computing a maximum safe time at which the source locks reliably onto a position of the target or a trajectory of the target. If the source is allowed to lock onto the target's position or trajectory, it can accurately aim at the target to track or damage the target. Therefore, at least one disruption of the electromagnetic radiation at or before that time may be desirable. The first release position is calculated from the time using the projectile's velocity and trajectory.

Operation 306 may include launching a projectile comprising a disruptive medium or a disruptive-medium precursor. The projectile may carry one disruptive-medium charge or more than one. The charge may include a container of the disruptive medium itself to be released "as-is" or a container of a precursor that is transformed into the disruptive medium upon release (e.g., by foaming, burning, explosion, allowing two previously separated substances to react, etc), The launching apparatus may be located, and the launching may be triggered, at any combination of the projectile itself, the target, or a remote platform.

Options for post-launch operations include Operation 317, in which a remote system (e.g., on the target or remote platform) guides the projectile post-launch; Operation 327, in which an internal system in the projectile guides the projectile post-launch; Operation 337, in which the remote system (e.g., on the target or remote platform) senses subsequent changes in source behavior (e.g., motion or changing a characteristic of the radiation such as its spectrum or pulse timing); or Operation 347, in which a system internal to the projectile senses subsequent changes in source behavior.

Operation 308 may include directing the projectile to the first release position. The projectile trajectory may be predetermined by the calculations before launching. A predetermined projectile trajectory may include Operation 318, trajectory changing (e.g., if the electromagnetic radiation is aimed at a side of the target other than the one that includes launching apparatus). Alternatively, in Operation 328 the projectile trajectory may be changed in-flight to respond to changes in the relative positions of the source and target. The position changes may be sensed, and the projectile trajectory change calculated and ordered, by apparatus internal to the projectile or by apparatus on the target or remote platform in communication with the projectile. The in-flight changes in response to sensed position changes may be adaptive (e.g., using artificial intelligence) or non-adaptive (e.g., using stored lookup tables of sensor readings and corresponding headings).

Figure 4:
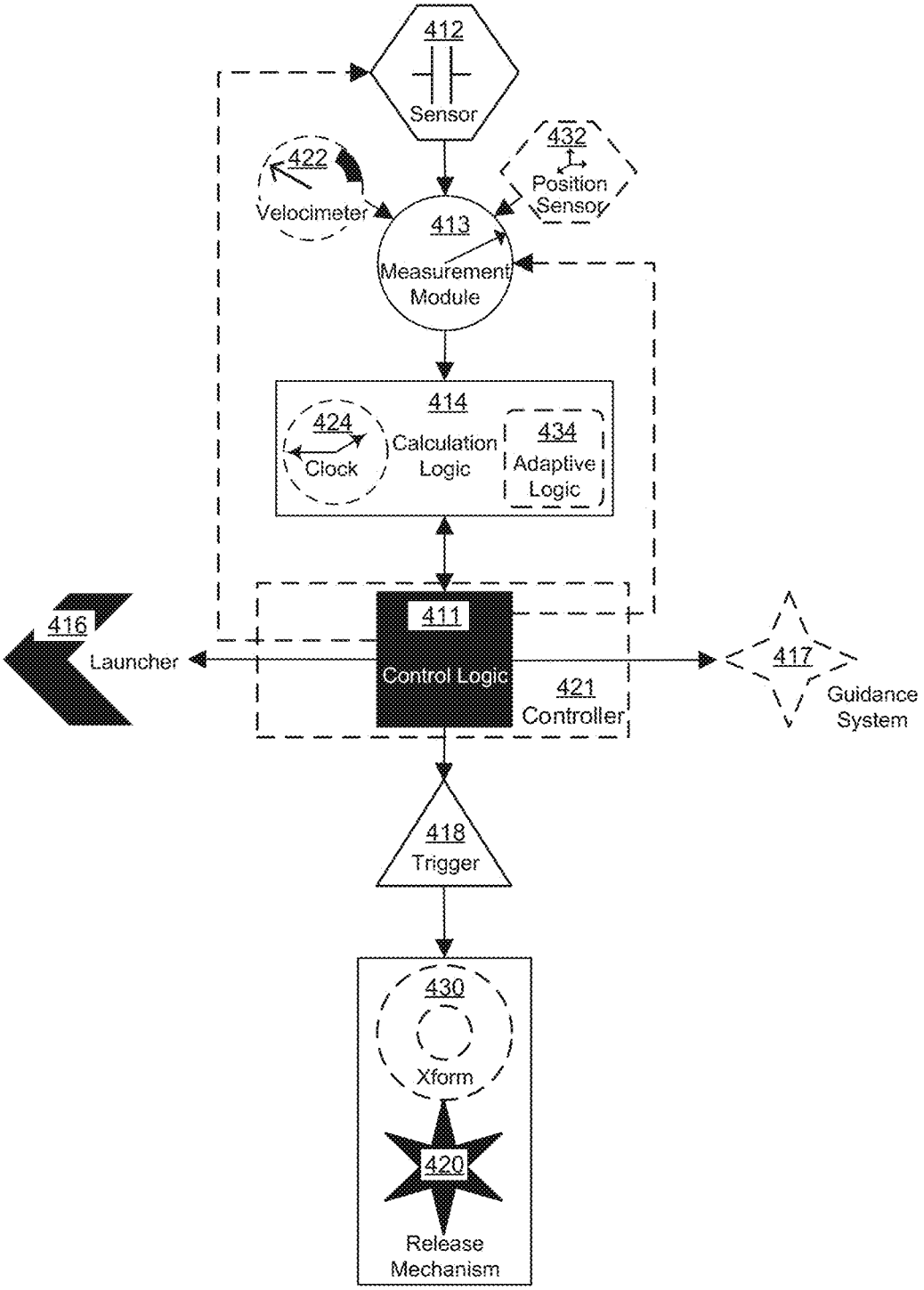
FIG. 4 is a block diagram of a radiation-disrupting system, in accordance with some embodiments.

Operation 312 may include releasing the disruptive medium from the projectile to form a cloud at the first release position. The release may be mechanical, electrostatic, magnetic, or involving a transformation of a disruptive-medium precursor to the actual disruptive medium (e.g., by foaming, burning, explosion, allowing two previously separated substances to react, etc), FIG. 4 is a block diagram of a radiation-disrupting system, in accordance with some embodiments.

In some embodiments, sensor 412 may sense one or more parameters of electromagnetic radiation. Measurement module 413 receives sensor 412's output and may optionally do some preliminary processing such as correcting for sensor nonlinearity, wavelength sensitivity, or baseline drift. Measurement module 413 may, in some embodiments, also receive and optionally process output from one or both of position sensor 432 and velocimeter 422.

Calculation logic 414 receives the measurements collected and optionally pre-processed by measurement module 413 and calculates one or more of maximum safe time, time-driven release position, source distance, source position, source range of propagation angles, or extent-driven release position. In some embodiments, calculation logic 414 may include, or may be connected to, clock 424. In some embodiments, calculation logic 414 may include adaptive logic 434, e.g., for artificial-intelligence-based post-launch guidance of the projectile.

Control logic 411 may be in a dedicated controller component 421 or may share space with other logic such as calculation logic 414. Alternatively, control logic 411 may be distributed in two or more locations, such as target-and-projectile or remote-system-and-target-and-projectile. Control logic 411 may control projectile launcher 416 when launching the projectile, disruptive-medium release trigger 419 when releasing the disruptive medium, and optional guidance system 417 during post-launch guidance of the projectile. In some embodiments, control logic 411 may create a closed control loop with one or both of sensor 412 and measurement module 413 to operate the detection hardware in two or more modes (e.g., maximum-sensitivity, power-saving, and others).

Disruptive-medium release trigger 419 may activate release mechanism 420 to release the disruptive-medium cloud. Where applicable, disruptive-medium release trigger 419 may also activate transformation module 430 to transform a disruptive-medium precursor into a disruptive medium, e.g., by spraying, misting, burning or explosion.

There are many ways to divide radiation-blocking functions between a target and its projectile(s). For example, if the projectile is completely destroyed by releasing its charge of disruptive medium, it may be desirable (e.g., for cost reasons) to locate the control and calculation in the target, arranging the trigger to communicate with the projectile post-launch to activate the projectile's release mechanism (with or without a transformation module) and, where applicable, guide the projectile. Alternatively, it may be more advantageous in other situations to locate more functions in the projectile, allowing it to operate partially or totally autonomously. For example, this solution may be cost-effective when retrofitting existing targets with this type of projectile because it could help minimize the changes to the target. As another example, this may be an attractive solution if the environment makes communication between the projectile and target difficult or inadvisable.

Figure 5A:
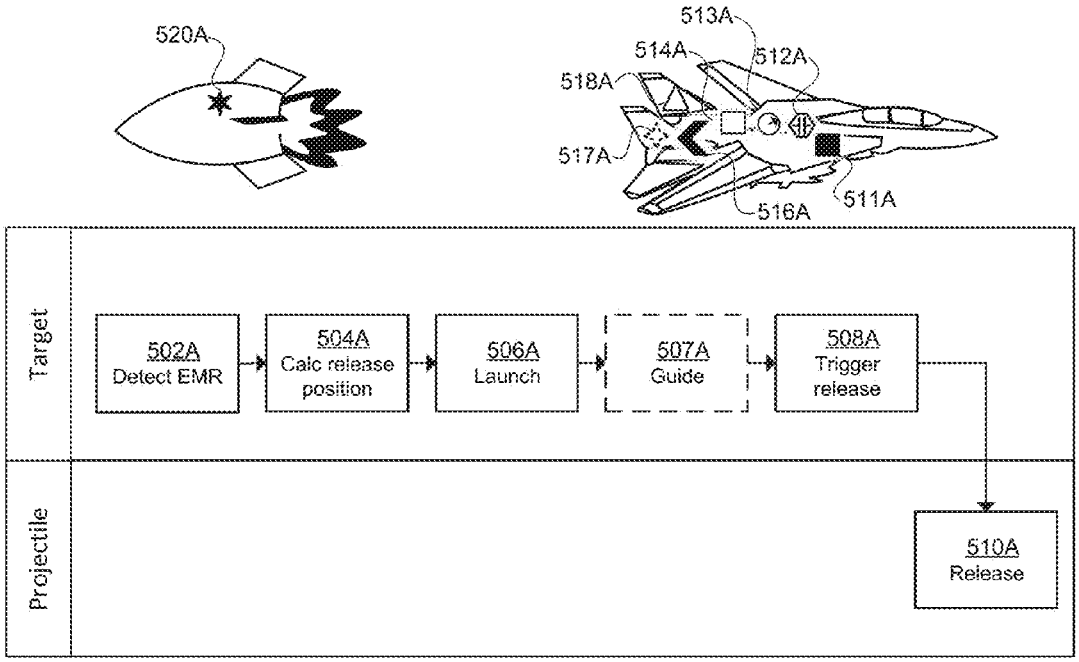
FIG. 5A is a diagram of a target controlling nearly all the radiation-blocking functions, in accordance with some embodiments.

FIG. 5A is a diagram of a target controlling nearly all the radiation-blocking functions, in accordance with some embodiments.

In some embodiments, release mechanism 520A, which performs function 510A of releasing the disruptive medium (including, where applicable, a transformation module to transform a disruptive-medium precursor to a disruptive medium) is located on the projectile. Meanwhile, all the other radiation-blocking components are located, and all the other functions performed, on the target. These components and functions include: sensor 512A and measurement module 513A, which perform function 502A of detecting electromagnetic radiation; calculation logic 514A, which performs function 504A of calculating one or more release positions; controller 511A, which controls one or more of the radiation-blocking functions; projectile launcher 516A, which performs function 506A of launching the projectile; remote guidance system 517A, which, if present, performs function 507A of remotely guiding the projectile to the release position(s); and remote trigger 518A, which performs function 508A of remotely triggering the projectile's release mechanism. In some embodiments, the projectile only releases the charge of disruptive medium when triggered and, where applicable, executes guidance commands received from the target.

Figure 5B:
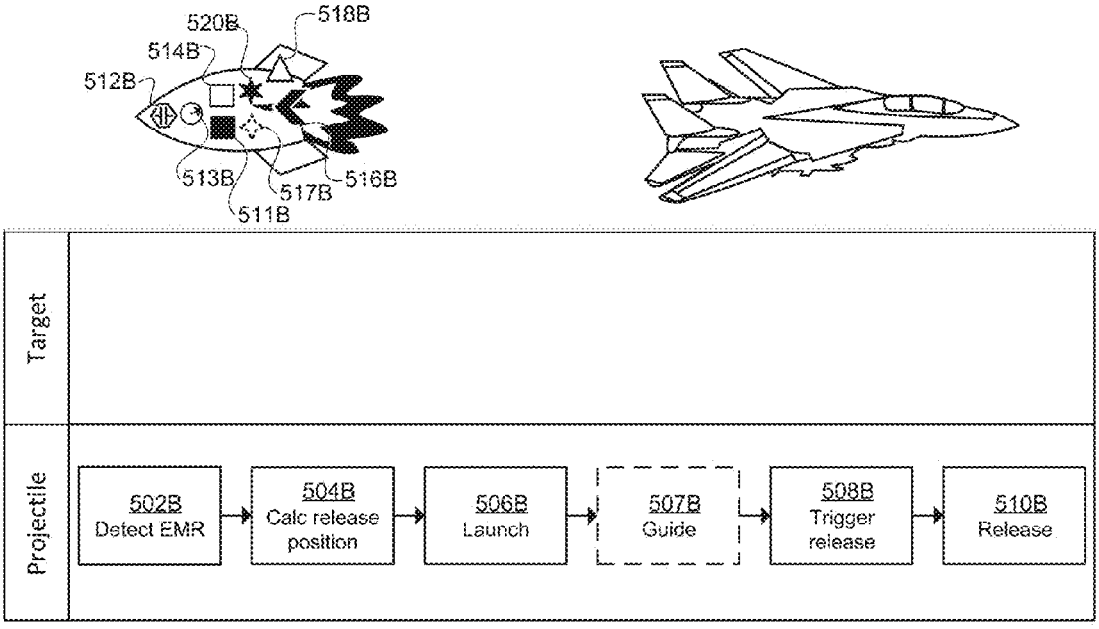
FIG. 5B is a diagram of a projectile controlling nearly all the radiation-blocking functions, in accordance with some embodiments.

FIG. 5B is a diagram of a projectile controlling nearly all the radiation-blocking functions, in accordance with some embodiments.

In some embodiments, all the radiation-blocking components are located, and all the functions performed, on the projectile. These components and functions include: sensor 512B and measurement module 513B, which perform function 502B of detecting electromagnetic radiation; calculation logic 514B, which performs function 504B of calculating one or more release positions; controller 511B, which controls one or more of the radiation-blocking functions; projectile launcher 516B, which performs function 506B of launching the projectile; internal guidance system 517B, which, if present, performs function 507B of guiding the projectile to the release position(s); internal trigger 518B, which performs function 508B of internally triggering the projectile's release mechanism; and release mechanism 520A, which performs function 510A of releasing the disruptive medium (including, where applicable, a transformation module to transform a disruptive-medium precursor to a disruptive medium). In some embodiments, the projectile may continuously or periodically communicate status to the target, so that a system on the target may monitor, record, or (if necessary) override the projectile's autonomous actions.

From the two extreme cases illustrated in FIGS. 5A and 5B, those skilled in the art will recognize that many intermediate solutions may be interpolated by moving some of the functions to the target or to the projectile. All these intermediate solutions are intended to be included in the scope of protected subject matter.

Figure 6A:
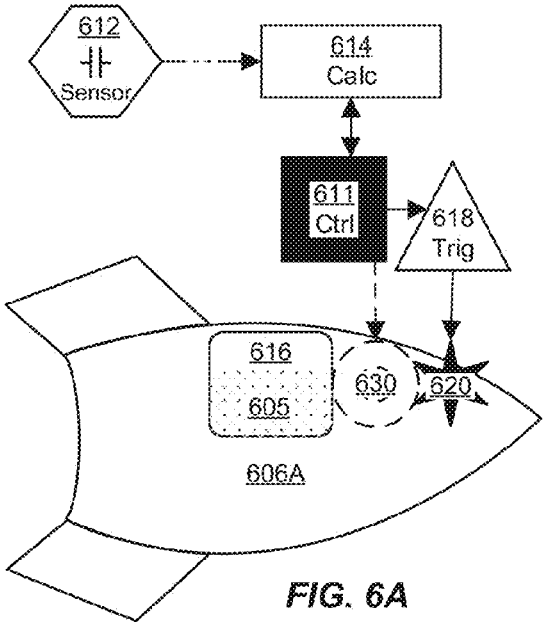
FIG. 6A is a single-charge projectile, in accordance with some embodiments.

FIG. 6A is a single-charge projectile, in accordance with some embodiments.

In some embodiments, a projectile 606A includes a container 616 containing a charge of disruptive medium 605 (or, alternatively, a disruptive-medium precursor to be transformed into a disruptive medium by optional transformation module 630). In either case, the disruptive medium may be released by release mechanism 620 in response to a signal from trigger 618. Trigger 618 may be on projectile 606A, or may be in a remote location with a communicative link to release mechanism 620. Control logic 611 may control release mechanism 620 and, if present, transformation module 630. Control logic 611 may be on projectile 606A, or may be in a remote location with a communicative link to trigger 618 and. if present, transformation module 630, Alternatively, control logic 611 may be distributed between projectile 606A and one or more remote locations coupled directly or indirectly by communicative links. Control logic 611 controls, and also receives information from, calculation logic 614 about, among others, the detection of electromagnetic radiation by sensor 612 and the release position where a cloud of disruptive medium 605 is to be released.

Figure 6B:
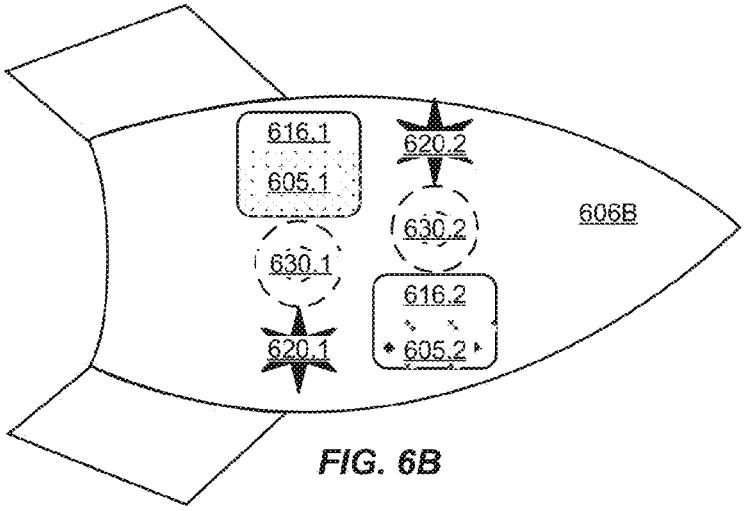
FIG. 6B is a multi-charge projectile, in accordance with some embodiments.

FIG. 6B is a multi-charge projectile, in accordance with some embodiments.

In some embodiments, projectile 606B includes a first container 616.1 containing a first disruptive medium or disruptive-medium precursor 605.1. Projectile 606B also includes a second container 616.2 containing a second disruptive medium or disruptive-medium precursor 605.2. As illustrated, first container 616.1 has its own dedicated first transformation module 630.1 and, where applicable, first transformation module 630.1. Likewise, second container 616.1 has its own dedicated second transformation module 630.1 and, where applicable, second transformation module 630.1. Alternatively, the containers 616.1 and 616.2 may share a common release mechanism, transformation module, or both. First disruptive medium or disruptive-medium precursor 605.1 and second disruptive medium or disruptive-medium precursor 605.2 may be different in composition, constituent size, quantity or other characteristics, or alternatively may be the same. Although not explicitly shown in this view, it is understood that first transformation module 630.1, second release mechanism 620.2 and, if present, first transformation module 630.1 and/or second transformation module 630.2 are directly or indirectly communicatively linked with control logic that causes the release of first disruptive medium 605.1 at a first release position and the release of second disruptive medium 605.2 at a second release position.

Figure 6C:
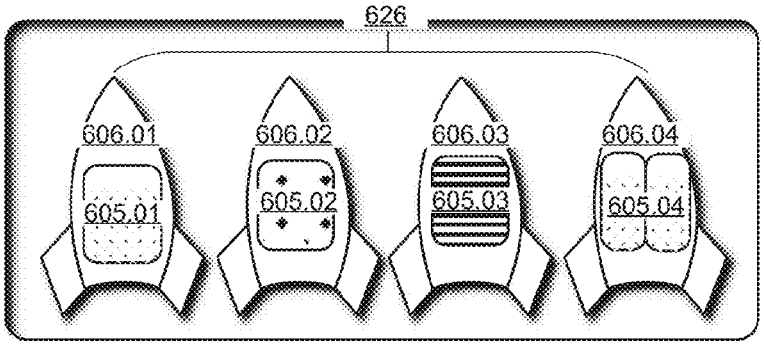
FIG. 6C is a set of selectable projectiles, in accordance with some embodiments.

FIG. 6C is a set of selectable projectiles, in accordance with some embodiments.

In some embodiments, a target or separate launching platform may include a set of selectable projectiles. Set of projectiles 626 may include first projectile 606.01, second projectile 606.02, third projectile 606.03, and fourth projectile 606.04. The control logic that controls projectile launching and disruptive-medium release may select one or more of the projectiles to respond to a given situation.

The individual projectiles in set 626 may be alike, or at least two of the projectiles 601.01-601.04 may differ in disruptive-medium composition, disruptive-medium constituent size, disruptive-medium quantity, number of disruptive-medium charges, or mechanisms for launching, guiding, transformation, or release. For example, in disruptive medium 605.01 and disruptive medium 605.04 may have the same composition, but projectile 606.01 carries a single charge and projectile 606.04 carries a double charge. Disruptive medium 605.02 in projectile 606.02 has a different composition. Projectile 606.03 carries a disruptive-medium precursor 605.3 that transforms into a disruptive medium upon release.

This variety of capabilities enables the control logic to select one or more projectiles matched to a parameter of the electromagnetic radiation being detected by the sensor(s). For example, disruptive medium 605.01 and disruptive medium 605.04 may be best for blocking visible wavelengths, disruptive medium 605.02 may be best for blocking infrared wavelengths, and the disruptive medium produced by precursor 605.03 may be best for blocking very high-intensity radiation.

Additionally, each projectile selected may receive different launch, guidance, and release-position instructions from the control logic. For example, projectiles 606.01 and 606.04 may be launched simultaneously, but projectile 606.01 may release its disruptive medium 605.01 at the time-driven release position and projectile 606.04 may release both charges of its disruptive medium 605.04, serially or concurrently, at an extent-driven release position.

Figure 7A:
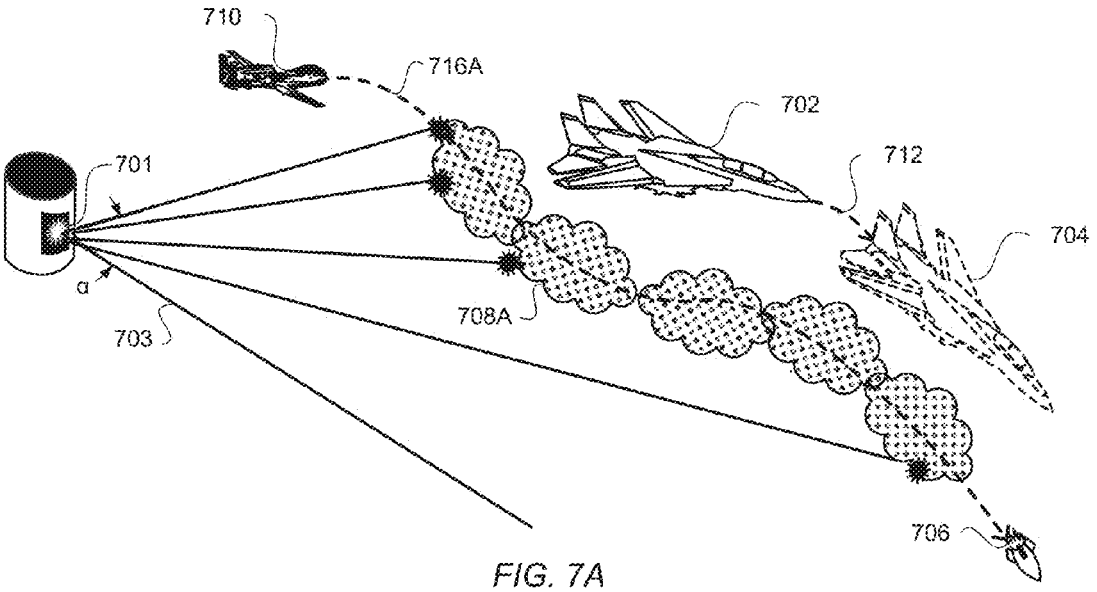
FIG. 7A illustrates a separate platform firing a projectile to protect a target, in accordance with some embodiments.

FIG. 7A illustrates a separate platform firing a projectile to protect a target, in accordance with some embodiments.

In some embodiments, a separate platform protects the target. In these illustrations, the separate platform 710 is another moving aircraft like target 702, but alternatively the separate platform may be stationary and/or either the separate platform, the target, or both may be in space, on land, in water, or underwater. When one or more sensors on target 702 detect electromagnetic radiation 703 from source 701, target 702 signals separate platform 710. Separate platform 710 launches projectile 706, which may be selected from a set of projectiles. Projectile 706 may follow projectile trajectory 716A between target 702 and source 701, fairly close to target 702, optionally slightly leading it to release group of disruptive-medium clouds (or continuous disruptive-medium trail) 708A at a series of time-driven release positions. Cloud series or trail 708A thus protects target 702 from electromagnetic radiation 703 over a range of propagation angles $\alpha$ while target 702 travels along target trajectory 712, passes through later target position 704. This approach may be expedient if, for example, separate platform 710 is much closer to target 702 than it is to source 701.

Figure 7B:
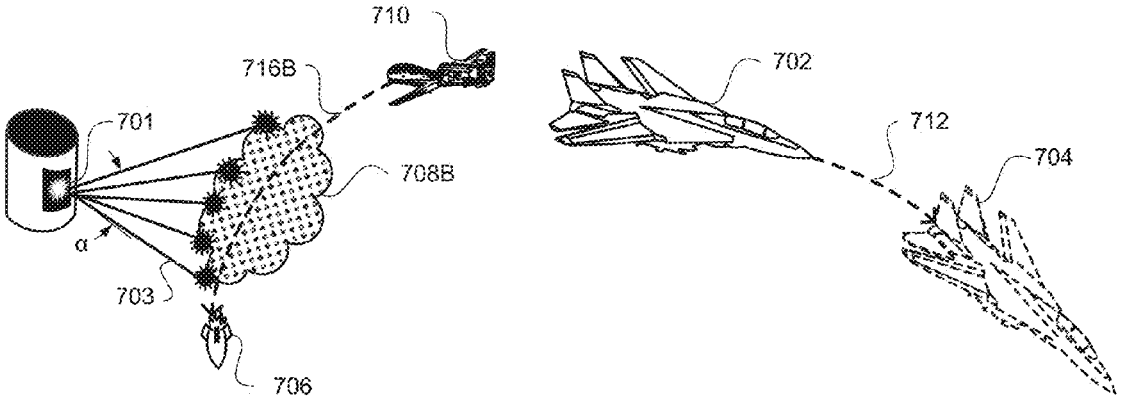
FIG. 7B illustrates another separate platform firing a projectile to protect a target, in accordance with some embodiments. Examples of Aircraft and Methods of Fabricating and Operating Aircraft

FIG. 7B illustrates another separate platform firing a projectile to protect a target, in accordance with some embodiments.

In some embodiments, upon the detection of electromagnetic radiation 703 impinging on or near target 702, separate platform 710 launches projectile 706 on projectile trajectory 716B toward source 701 to release cloud 708B at an extent-driven release position. At this position cloud 708B blocks electromagnetic radiation 703 over the full range of propagation angles $\alpha$, which may be all of electromagnetic radiation 703 or all of it above a critical threshold of tracking or damage. Cloud 708B thus protects target 702 along its target trajectory 712 through target position 704. This approach may be expedient, for example, where separate platform 710 is much closer to source 701 than to target 702.

Examples of Aircraft and Methods of Fabricating and Operating Aircraft

Figure 8:
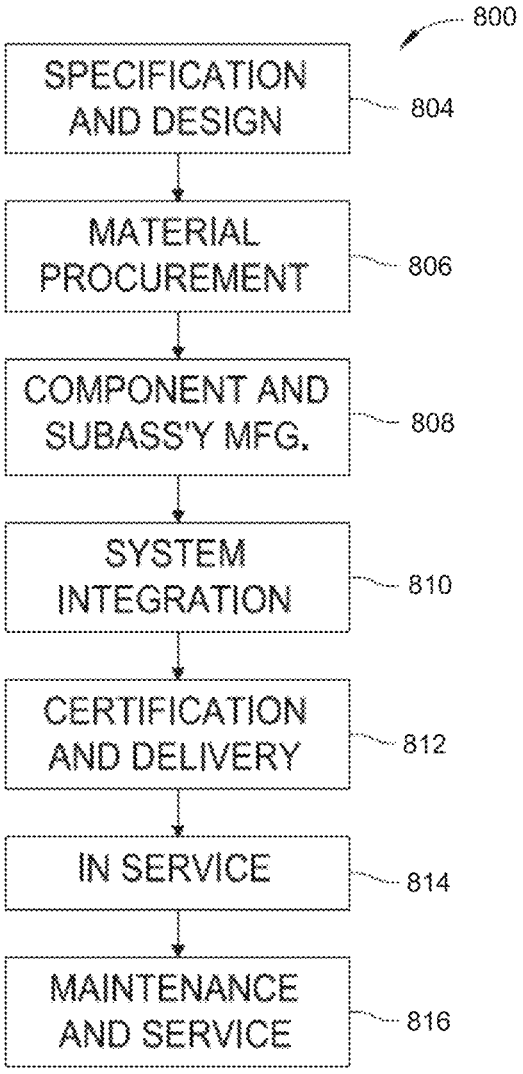
FIG. 8 is a flowchart of phases of aircraft design, manufacturing, use, and maintenance, in accordance with some embodiments.
Figure 9:
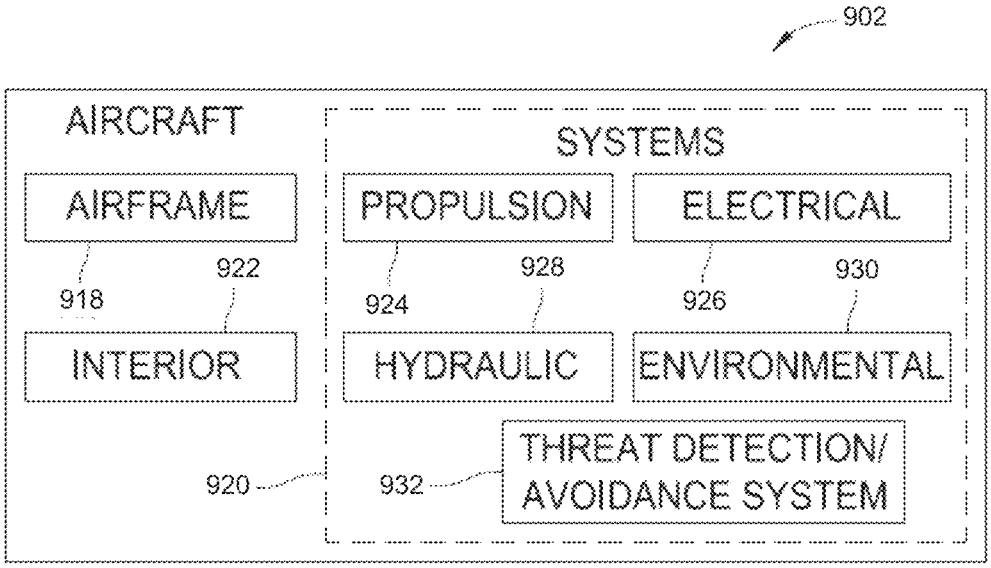
FIG. 9 is a block diagram of aircraft components and systems, in accordance with some embodiments.

FIG. 8 is a flowchart of phases of aircraft design, manufacturing, use, and maintenance, in accordance with some embodiments. FIG. 9 is a block diagram of aircraft components and systems, in accordance with some embodiments.

Referring to the drawings, implementations of the disclosure may be described in the context of an aircraft manufacturing and service method 800 (shown in FIG. 8) and via an aircraft 902 (shown in FIG. 9). During pre-production, including specification and design 804, data of aircraft 902 may be used during the manufacturing process and other materials associated with the airframe may be procured 806. During production, component and subassembly manufacturing 808 and system integration 810 of aircraft 902 occurs, prior to aircraft 902 entering its certification and delivery process 812. Upon successful satisfaction and completion of airframe certification, aircraft 902 may be placed in service 814. While in service by a customer, aircraft 902 is scheduled for periodic, routine, and scheduled maintenance and service 816, including any modification, reconfiguration, and/or refurbishment, for example. In alternative implementations, manufacturing and service method 800 may be implemented on platforms other than an aircraft.

Each portion and process associated with aircraft manufacturing and/or service 800 may be performed or completed by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator maybe an airline, leasing company, military entity, service organization, and so on.

As shown in FIG. 9, aircraft 902 produced via method 800 may include an airframe 918 having a plurality of systems 920 and an interior 922. Examples of high-level systems 920 include one or more of a propulsion system 924, an electrical system 926, a hydraulic system 928, an environmental system 930, and/or a threat detection/avoidance system 932. Threat detection/avoidance system 932 may include a sensor operable to detect electromagnetic radiation aimed at a target; a measurement module operable to characterize the electromagnetic radiation; calculation logic operable to calculate a first release position to release a disruptive-medium cloud protecting the target based on characterization by the measurement module; at least two of a clock, a position sensor, or a velocimeter; a projectile launcher; a projectile operable to release the disruptive-medium cloud; and control logic operable to trigger the release of the disruptive-medium cloud at the first release position.

Apparatus and methods embodied herein may be employed during any one or more of the stages of method 800. For example, components or subassemblies corresponding to component and subassembly production process 808 may be fabricated or manufactured in a manner similar to components or subassemblies produced while aircraft 902 is in service 814. Also, one or more apparatus implementations, method implementations, or a combination thereof may be utilized during the production stages 808 and 810, for example, by substantially expediting assembly of, and/or reducing the cost of assembly of aircraft 902. Similarly, one or more of apparatus implementations, method implementations, or a combination thereof may be utilized while aircraft 902 is being serviced or maintained, for example, during scheduled maintenance and service 816.

Conclusion

Different examples disclosed herein may include a variety of components, features, and functionalities. It should be understood that it may be possible for some or all of the individual examples to alternatively include one or more components, features, or functionalities described with reference to other examples. Regardless of whether these alternative components, features, or functionalities are substituted singly or in any combination, all of such possibilities are intended to be included in the spirit and scope of the present disclosure.

Modifications of the disclosed examples may occur to one skilled in the disclosure's pertinent art after gaining the benefit of the teachings presented in the foregoing descriptions and the associated drawings. However, it is to be understood that the scope of the present disclosure is not limited to the specific examples described or illustrated. Modifications and different combinations of elements and/or functions are intended to be included in the scope of the appended claims. Accordingly, any parenthetical reference numerals in the appended claims are intended to demonstrate how an illustrated example may represent a single embodiment of the claimed subject matter, not to limit the claim scope to the illustrated example.

What is claimed is:

1. A method, comprising:

detecting electromagnetic radiation aimed at a target from a source;

calculating a first release position to disrupt the electromagnetic radiation thereby protecting the target, the first release position being a spatial position where a disruptive medium or a disruptive-medium precursor is released from a projectile;

launching the projectile comprising the disruptive medium or the disruptive-medium precursor;

directing the projectile to the first release position; and releasing the disruptive medium or the disruptive-medium precursor from the projectile at the first release position, the disruptive-medium precursor being operable to transform into the disruptive medium while releasing the disruptive-medium precursor, wherein the releasing of the disruptive medium or the disruptive-medium precursor forms a cloud of the disruptive medium.

2. The method of claim 1, wherein at least one of the detecting, the calculating, or the launching is performed at the target.

3. The method of claim 1, wherein at least one of the detecting, the calculating, or the launching is performed remotely from the target.

4. The method of claim 1, wherein the calculating of the first release position comprises;

computing a position of the source; and computing a distance from the source at which the cloud obscures a predetermined range of a propagation angles ($\alpha$) of the electromagnetic radiation.

5. The method of claim 1, further comprising calculating a second release position to disrupt the electromagnetic radiation thereby continuing to protect the target, the second release position being an additional spatial position of where the disruptive medium or the disruptive-medium precursor is further released from the projectile;

directing the projectile to the second release position; and releasing the disruptive medium or the disruptive-medium precursor from the projectile at the second release position;

wherein the releasing of the disruptive medium or the disruptive-medium precursor forms an additional, cloud of the disruptive medium.

6. The method of claim 1, wherein the electromagnetic radiation comprises tracking radiation;

wherein the calculating of the first release position comprises computing a time at which the source locks reliably onto a position of the target or a trajectory of the target.

7. The method of claim 1, wherein the calculating of the first release position comprises computing a time window between detecting the electromagnetic radiation and an exposure threshold, the time window is computed based on at least one of wavelength of the electromagnetic radiation, intensity of the electromagnetic radiation, or an incident angle of the source to the target.

8. The method of claim 1, wherein the projectile is selected from a set of projectiles based on a sensed parameter of the electromagnetic radiation;

wherein the disruptive medium or the disruptive-medium precursor differs in composition, constituent size, quantity, or a number of charges between at least two members of the set of projectiles.

9. The method of claim 1, wherein the launching comprises a use of at least one of gravity, compressed gas, expanding gas, an electromagnetic field, or an engine attached to the projectile.

10. The method of claim 1, further comprising changing a course of the projectile after the launching.

11. The method of claim 1, further comprising sensing a change in the electromagnetic radiation or a relative position of the source and the target after the launching; and re-calculating the first release position to compensate for the change.

12. The method of claim 1, wherein after the launching, the projectile is guided toward the first release position by a remote system.

13. The method of claim 1, wherein after the launching the projectile is guided toward the first release position by a system internal to the projectile.

14. The method of claim 1, wherein the releasing is triggered by a system internal to the projectile.

15. The method of claim 1, wherein the releasing comprises spraying, misting, burning, or explosion.

16. A projectile, comprising:

a first container, comprising a first disruptive medium or a first disruptive-medium precursor, a first release mechanism, operable to release the first disruptive medium or the first disruptive-medium precursor from the first container;

the first disruptive-medium precursor being operable to transform into the first disruptive medium while releasing the first disruptive-medium precursor, the first disruptive medium being operable to block electromagnetic radiation;

a controller, in communication with the first release mechanism;

calculation logic, in communication with the controller;

wherein the controller triggers the first release mechanism to release the first disruptive medium or the first disruptive-medium precursor at a first release position, the first release position being a spatial position where the disruptive medium or the disruptive-medium precursor is released from the projectile;

wherein the calculation logic calculates the first release position in response to detection of electromagnetic radiation by a sensor in communication with the controller or with the calculation logic.

17. The projectile of claim 16, further comprising a second container, comprising a second disruptive medium or a second disruptive-medium precursor, having a second release mechanism, operable to release the second disruptive medium or the second disruptive-medium precursor, the second disruptive-medium precursor being operable to transform into the second disruptive medium while releasing the second disruptive-medium precursor, the second disruptive medium being operable to block the electromagnetic radiation;

the second release mechanism being in communication with the controller;

wherein the controller triggers the second release mechanism to release the second disruptive medium or the second disruptive medium at a second release position; and wherein the second release position differs from the first release position.

18. The projectile of claim 16, wherein at least one of the controller, the sensor, or the calculation logic are internal to the projectile.

19. A system, comprising:

a sensor, operable to detect electromagnetic radiation aimed at a target;

a measurement module, operable to characterize the electromagnetic radiation;

calculation logic, operable to calculate a release position for a disruptive medium or a disruptive-medium precursor to protect the target based on a characterization by the measurement module;

at least two of a clock, a position sensor, or a velocimeter;

a projectile launcher;

a projectile, comprising a container and a release mechanism the container comprising the disruptive medium or the disruptive-medium precursor, the release mechanism being operable to release the disruptive medium or the disruptive-medium precursor from the container at the release position;

the release position being a spatial position where the disruptive medium or the disruptive-medium precursor is released from the projectile;

the disruptive-medium precursor being operable to transform into the disruptive medium while releasing the disruptive-medium precursor, the disruptive medium being operable to block the electromagnetic radiation; and control logic, operable to trigger the release mechanism to release the disruptive-medium or the disruptive-medium precursors at the release position.

20. The system of claim 19, further comprising adaptive logic operable to change a course of the projectile or to recalculate the release position in response to a change in the characterization while the projectile is in motion.

* * * * *